United States Patent [19]

Janssen et al.

[11] Patent Number: 4,958,996

[45] Date of Patent: Sep. 25, 1990

[54] ROTARY DEVICE HAVING INTER-ENGAGING INTERNAL AND EXTERNAL TEETH

[75] Inventors: Sylvain Janssen, Neuilly; Claude Fouinaud, Montrouge; Gérard Lagarde, Longjumeau, all of France

[73] Assignee: Schlumberger Industries, S.A., Montrouge, France

[21] Appl. No.: 355,581

[22] Filed: May 23, 1989

[30] Foreign Application Priority Data

May 25, 1988 [FR] France ..... 88 06920

[51] Int. Cl.[5] ..... F04C 2/10

[52] U.S. Cl. ..... 418/152; 418/169

[58] Field of Search ..... 418/168, 169, 152

[56] References Cited

U.S. PATENT DOCUMENTS

| | | | |
|---|---|---|---|
| 1,496,737 | 6/1924 | Petersen | 418/169 |
| 2,601,397 | 6/1952 | Hill | 418/169 |
| 2,615,399 | 10/1952 | Edwards | 418/169 |
| 2,621,603 | 12/1952 | Thomas | 418/169 |
| 2,672,824 | 3/1954 | Quintilian | 418/168 |
| 3,233,524 | 2/1966 | Charlson | 418/152 |
| 3,276,288 | 10/1966 | Schimkat | 418/169 |

*Primary Examiner*—John J. Vrablik
*Assistant Examiner*—David L. Cavanaugh
*Attorney, Agent, or Firm*—Frishauf, Holtz, Goodman & Woodward

[57] ABSTRACT

A rotary device for interacting with a flow of liquid. The rotary device comprises a casing provided with an inlet opening and an outlet opening. The casing contains a first rotary member having a first axis of rotation (YY') and external teeth, and a second rotary member surrounding the external teeth of the first rotary member and guided to rotate about a second axis (XX') parallel to the first axis. The second rotary member includes two circular rings mounted inside the casing to occupy two respective planes perpendicular to the first axis of rotation (YY'), and a plurality of longitudinal components mounted between the rings to lie parallel with the second axis of rotation (XX'). Each of the longitudinal components has a cross-section in the shape of a gear tooth for meshing with the teeth of the first member. The rings have regularly spaced-apart notches around their peripheries in order to receive the ends of the longitudinal components, the longitudinal components not being fixed to the rings.

4 Claims, 3 Drawing Sheets

ROTARY DEVICE HAVING INTER-ENGAGING INTERNAL AND EXTERNAL TEETH

The present invention relates to a rotary gear device for interacting with a flow of liquid.

More precisely, the invention relates to a rotary gear device capable of operating either as a pump for causing a liquid to flow, and in particular a hydrocarbon, or else as a flow meter for measuring the rate at which a liquid, in particular a hydrocarbon, is flowing.

Figure 1:
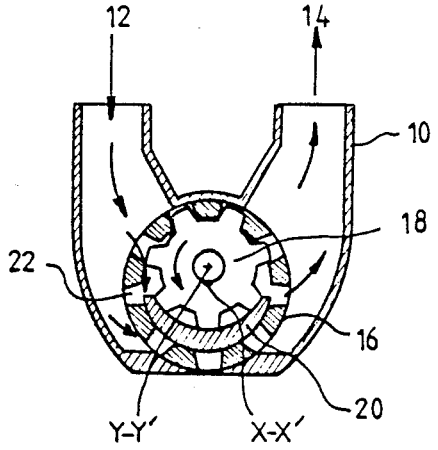
FIG. 1 (PRIOR ART)

Gear pumps, in particular for pumping hydrocarbons, are well known. FIG. 1 shows such a pump. It comprises a pump body 10 provided with an admission duct 12 and a delivery duct 14 for liquid. A gear 16 having internal teeth is mounted inside the pump body 10 to rotate about a first axis XX'. Inside the gear 16 there is a gear 18, e.g. a driving gear, having external teeth and driven to rotate about an axis YY' which is parallel to the axis XX'. The gear 18 meshes partially with the gear 16 because of its excentric position. The gears 16 and 18 are kept apart over a portion of their circumferences by a part 20 having generator lines running parallel to the axes XX' and YY'. The gear 16 has openings 22 corresponding to the bottoms of its teeth, thereby allowing liquid to pass from the suction side to the inside zone of the gear 16, and from said inside zone to the delivery side. Under the effect of the relative rotary motions of the gears 16 and 18, liquid is sucked in from the suction duct 12 into the inside zone of the gear 16, and is then delivered from said inside zone to the delivery duct 14.

The theory of such pumps is well known, but they are difficult and expensive to manufacture. In particular, it is very expensive to make the outer gear with internal teeth which is to receive the inner gear with external teeth. It is not possible to make this squirrel cage shaped part completely by molding or by sintering.

An object of the present invention is to provide a rotary gear device, in particular a gear pump of the above-described type, in which at least the outer gear can be made by molding or by sintering.

The present invention achieves this object by providing a rotary device for interacting with a flow of liquid, the device comprising: a casing provided with an inlet opening and an outlet opening, said casing containing: a first rotary member having an axis of rotation and external teeth; and a second rotary member surrounding the external teeth of said first rotary member and guided to rotate about a second axis parallel to the first axis; said second member comprising two circular rings mounted inside said casing to occupy two respective planes perpendicular to said first axis, and a plurality of longitudinal components mounted between said rings to lie parallel with the second axis, each of said longitudinal components having a right cross-section in the shape of a gear tooth for meshing with the teeth of said first member, said rings having regularly spaced-apart notches around their peripheries in order to receive the ends of said longitudinal components, said longitudinal components not being fixed to said rings.

Figure 2:
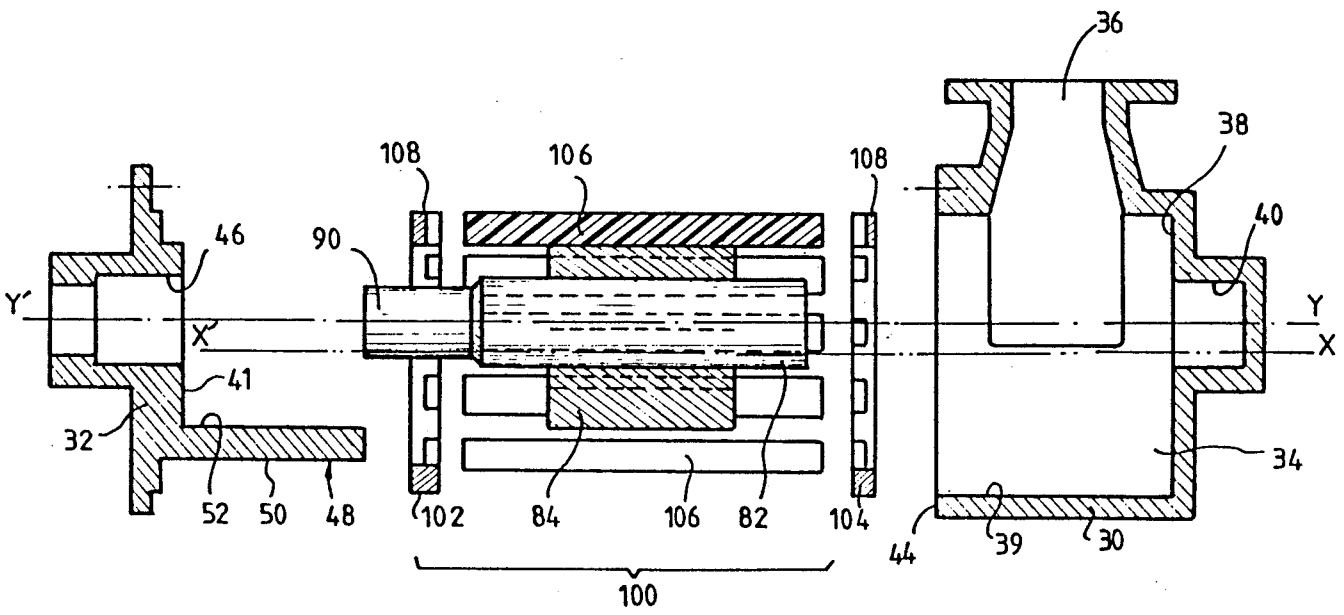
Figure 3A:
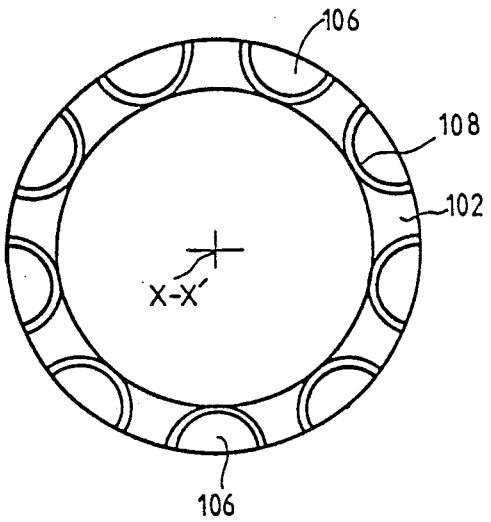
Figure 3B:
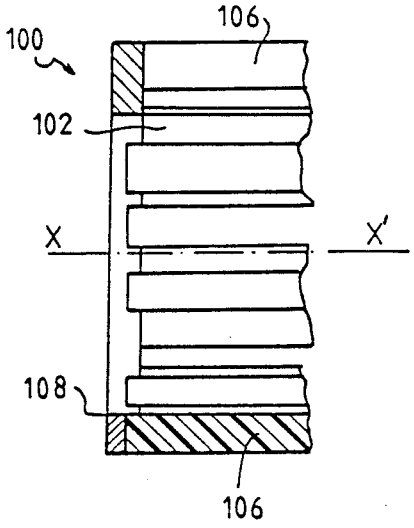
Figure 4A:
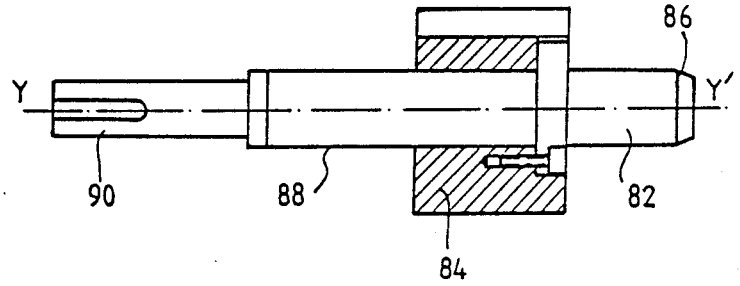
Figure 4B:
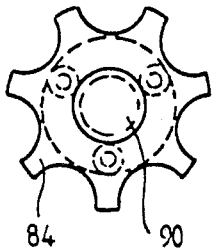

The invention will be better understood from reading the following description of an embodiment of the invention given by way of non-limiting example and made with reference to the accompanying drawings, in which:

FIG. 1, as described above, is an elevation section view through a prior art gear pump;

FIG. 2 is an exploded view of an embodiment of a gear pump in accordance with the invention;

FIG. 3*a* is a fragmentary end view of a portion of the components constituting the outer gear of the pump;

FIG. 3*b* is a fragmentary vertical section through the FIG. 3*a* gear component;

FIG. 4*a* is an axial section view through the inner gear of the gear pump; and FIG. 4*b* is a view of the lefthand end as shown in FIG. 4*a* of the inner gear.

Reference is made initially to FIG. 2 for describing an embodiment of a gear pump in accordance with the invention.

The pump comprises a body constituted by a main casing 30 closed by an end plate 32. The casing 30 defines a cylindrical cavitY 34 about an axis XX'. A suction duct 36 visible in FIG. 2 opens out into the cavity 34, as does a delivery duct which is not shown. The wall 38 of the casing 30 perpendicular to the axis XX' includes an abutment bearing 40 about an axis YY' which is offset from the axis XX', as shown in FIG. 2.

The periphery 42 of the end plate 32 is suitable for fixing by any appropriate means to the edge 44 of the casing 30, and the end plate 32 defines a bearing 46 whose axis coincides with the axis YY' when the end plate 32 is mounted on the casing 30. The end plate 32 includes an extension 48 projecting from its inside face in order to define the part 20 of crescent-shaped cross-section shown in FIG. 1. The external face 50 of the extension 48 is a portion of a circular cylinder about the axis XX', whereas its inside face 52 is a portion of a circular cylinder about the axis YY'. The cavity 34 is generally cylindrical in shape being delimited by a side wall 39 and by two end walls 38 and 41 (end plate 32).

An outer gear 100 is mounted inside the pump body.

A particular implementation of the outer gear 100 for a gear pump of the invention is described with reference to FIGS. 3*a* and 3*b*. The outer gear referenced 100 comprises two circular end rings 102 and 104 together with a plurality of identical longitudinal components 106 running parallel to the axis XX' of the outer gear 100. Each end ring 102 or 104 has the same number of notches 108 around its periphery as there are longitudinal components 106. The depth of each notch 108 is less than the thickness of the ring 102 or 104 such that the residual thickness serves as an axial abutment in the XX' direction for the longitudinal components 106. In the example described, there are nine components 106. The notches 108 are machined to receive the ends of the longitudinal components 106 with a small amount of clearance as shown in FIGS. 3*a* and 3*b*. In right cross-section, each longitudinal component is in the form of a gear tooth.

The pump also comprises an inner gear 80. As shown in FIG. 4*a*, the gear 80 comprises a shaft 82 having a gear wheel 84 with external teeth fixed thereon. The gear wheel 84 may have seven teeth, for example, which are cut to mesh with the teeth of the outer gear formed by the longitudinal components 106. The shaft 82 has a first end 86 which forms a bearing surface for engaging the bearing 40 in the pump body and on the other side of the gear wheel 82 it has a bearing surface 88 for engaging the bearing 46 in the end plate 32, followed by an end 90 for coupling to drive means.

It will be understood that by mounting the ring 104, the longitudinal components 106, and the ring 102, in that order, in the cavity 36 of the pump body SO, the structure of the outer gear 100 is reconstituted exactly.

The longitudinal components 106 are held axially by the end rings 102 and 104 which are disposed in planes perpendicular to the axis XX', and they are held in place radially by the cylindrical side wall of the cavity 36. Similarly, the rings 102 and 104 are held in place by the side wall 39 and by the end walls 38 and 41 of the cavity 36. The assembly has a small amount of clearance along the axis XX' in order to accommodate differential thermal expansion effects. The various parts constituting the outer gear 100 are easily made by molding or by sintering (sintered steel). This is particularly true of the rings 102 and 104. The longitudinal components 106 may advantageously be cut from a rod of Delrin having the appropriate cross-section. The longitudinal components 106 and the notches 108 are preferably delimited by portions of circularly cylindrical surfaces about a common axis, with each of said axes lying parallel to the axis XX'. Thus, each longitudinal component guided by its pair of notches 108 is capable of pivoting to a limited extent about its own axis when meshing with a tooth of the inner gear.

In a variant, the notches 108 provided in the ring 102 and 104 may occupy the entire thickness thereof. In this case, after the components constituting the outer gear have been assembled, the longitudinal components 106 are held longitudinally by the inside walls of the casing and of the end plate where they extend perpendicularly to the axis XX'.

In the above description, it has been assumed that the device constitutes a gear pump for causing a liquid to flow, with the shaft 82 of the inner gear being driven in rotation. However, it will be understood that the same device can also operate as a flow meter, in which case rotation of the projecting portion 90 of the shaft 82 is representative of the rate of flow of the liquid passing through the flow meter casing.

We claim:

1. A rotary device for interacting with a flow of liquid, the device comprising:

a casing having a cavity defined by a substantially cylindrical side wall, said cavity being in communication with an inlet opening and an outlet opening, said casing containing:

a first rotary member having a first axis of rotation (YY') and external teeth; and a second rotary member surrounding the external teeth of said first rotary member and guided to rotate about a second axis (XX') parallel to the first axis, said second member comprising two circular rings mounted inside said casing to occupy two respective planes perpendicular to said first axis (YY'), and a plurality of longitudinal components mounted between said rings to lie parallel with the second axis (XX'), each of said longitudinal components having a transverse cross-section in the shape of a gear tooth for meshing with the teeth of said first member, said rings having regularly spaced-apart, radially outwardly opening notches around their peripheries in order to receive the ends of said longitudinal components, said longitudinal components being freely engaged within said notches to allow a slidable fit between said components and said rings, and being radially maintained within said notches by said cylindrical side wall.

2. A rotary device according to claim 1, in which said cavity is further defined by two end faces perpendicular to the second axis (XX'), said second member being guided in rotation by said two end faces and said substantially cylindrical side wall.

3. A rotary device according to claim 1, in which said longitudinal components are made of a plastic material and said rings are made of metal.

4. A rotary device according to claim 1, wherein said longitudinal components have ends shaped relative to said notches to enable at least limited pivotal movement of the longitudinal components relative to said rings about an axis parallel to said first axis (XX').

* * * * *